US012498205B2

(12) United States Patent
Haas

(10) Patent No.: US 12,498,205 B2
(45) **Date of Patent: *Dec. 16, 2025**

(54) BROADHEAD

(71) Applicant: TrikaUSA Inc., Superior, WI (US)

(72) Inventor: Matt Haas, Superior, WI (US)

(73) Assignee: TRIKA USA INC., Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/283,508

(22) Filed: Jul. 29, 2025

(65) Prior Publication Data

US 2025/0354785 A1 Nov. 20, 2025

Related U.S. Application Data

(63) Continuation-in-part of application No. 18/941,207, filed on Nov. 8, 2024.

(60) Provisional application No. 63/838,539, filed on Jul. 3, 2025, provisional application No. 63/597,420, filed on Nov. 9, 2023.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,564,713 | A * | 10/1996 | Mizek | F42B 6/08 473/583 |
| 6,174,252 | B1 * | 1/2001 | Mizek | F42B 6/08 473/583 |
| 6,258,000 | B1 * | 7/2001 | Liechty, II | F42B 6/08 473/583 |
| 6,910,979 | B2 * | 6/2005 | Barrie | F42B 6/08 473/583 |
| 7,771,298 | B2 | 8/2010 | Pulkrabek | |
| 7,905,802 | B2 * | 3/2011 | Erhard | F42B 6/08 473/583 |
| 8,016,704 | B1 * | 9/2011 | Vandewater | F42B 6/08 473/583 |
| 8,043,177 | B2 * | 10/2011 | Flanagan | F42B 6/08 473/583 |
| 8,905,874 | B2 * | 12/2014 | Sullivan | F42B 6/08 473/583 |
| 9,194,673 | B1 * | 11/2015 | Lee | F42B 6/08 |
| 10,571,233 | B2 * | 2/2020 | Hand | F42B 6/08 |
| 12,264,904 | B2 | 4/2025 | Bowmar et al. | |
| 2025/0189279 | A1 | 6/2025 | Bowmar et al. | |

* cited by examiner

*Primary Examiner* — John A Ricci
(74) *Attorney, Agent, or Firm* — Foley & Lardner LLP

(57) ABSTRACT

A broadhead includes a body, a blade member, and a plunger. The body defines a target penetrating end. The blade member is positioned partially within an inner volume of the body. The blade member is configured to rotate and translate relative to the body by a pin that is fixedly coupled with the body being received through a slot of the blade member. The blade member is transitionable between a retracted position and a deployed position. The plunger is bias by a spring in a longitudinal direction towards the target penetrating end. The plunger is configured to be received within a recess of the blade member when the blade member is in the retracted position.

14 Claims, 20 Drawing Sheets

BROADHEAD

CROSS-REFERENCE TO RELATED PATENT APPLICATION

This application (i) claims the benefit of and priority to U.S. Provisional Application No. 63/838,539, filed Jul. 3, 2025, and (ii) is a continuation in part of U.S. application Ser. No. 18/941,207, filed Nov. 8, 2024, which claims the benefit of and priority to U.S. Provisional Application No. 63/597,420, filed Nov. 9, 2023, the entire disclosures all of which are incorporated by reference herein.

BACKGROUND

The present disclosure relates generally to hunting equipment. More specifically, the present disclosure relates to archery hunting equipment.

SUMMARY

One embodiment of the present disclosure relates to a broadhead. The broadhead includes a body, a spring-loaded retaining member, a pin, and a pair of blade members. The body includes a target penetrating end, an inner volume accessible through opposite sides of the body, and a bore extending longitudinally through an end of the body opposite the target penetrating end. The bore provides access to the inner volume in a longitudinal direction. The spring-loaded retaining member is positioned within at least one of the bore or the inner volume. The spring-loaded retaining member is biased to translate in the longitudinal direction towards the target penetrating end. The pin extends through the inner volume. The pair of blade members each include a slot and a notch. The pair of blade members are positioned partially within the inner volume. The pin of the broadhead is received within the slots of the blade members. The notches of the blade members are both configured to receive the spring-loaded retaining member when the pair of blade members are in retracted positions and the notches are aligned.

In some embodiments, the pair of blade members are configured to be driven to move out of the retracted positions and into fully deployed positions by contact with a target. The pair of blade members each include a first end and a contact surface. The contact surfaces are configured to be driven by the target as the broadhead plunges into the target such that the blade members are driven to move and rotate along the slot from the retracted positions to the fully deployed positions.

In some embodiments, the spring-loaded retaining member includes a plunger and a spring. The plunger is configured to engage the notches of the blade members. The notch is defined on a rear of each of the blade members facing the end of the body opposite the target penetrating end.

In some embodiments, the pair of blade members include a first blade member and a second blade member. The first blade member protrudes from a first side of the broadhead and the second blade member protrudes from a second side of the broadhead. The first blade member and the second blade member are configured to move in opposite directions from the body as the target penetrating end of the broadhead penetrates the target.

In some embodiments, the broadhead includes a cap and a spring. The spring is positioned between the spring-loaded retaining member and the cap. The cap is fixedly coupled with the body. The cap includes threads to couple the broadhead with an arrow. In some embodiments, the slot of the blade member is positioned proximate a front end of the blade member at which the blade member is coupled with the body via the pin.

Another embodiment of the present disclosure relates to a broadhead. The broadhead includes a body, a first blade member and a second blade member, and a member. The body defines a target penetrating end. The first blade member and the second blade member are both positioned partially within an inner volume of the body and configured to rotate and translate relative to the body about a pin that is fixedly coupled with the body and is received through a first slot of the first blade member and a second slot of the second blade member. The first blade member and the second blade member are transitionable between retracted positions and deployed positions. The member is bias by a spring in a longitudinal direction towards the target penetrating end. The member is configured to be received within a first recess of the first blade member and a second recess of the second blade member when the first blade member and the second blade member are in the retracted positions.

In some embodiments, the broadhead includes a retaining member coupled in a bore of the body at an end of the body opposite the target penetrating end. The retaining member is configured to retain the spring within the bore and also configured to define external threads that protrude from the end of the body opposite the target penetrating end to couple the broadhead with a shaft of an arrow.

In some embodiments, the bore and the inner volume cooperatively form a space within which the member and the spring are positioned. In some embodiments, the body includes slots formed on opposite sides of the body. The slots provide access to the inner volume through which the first blade member and the second blade member protrude.

In some embodiments, the first recess of the first blade member and the second recess of the second blade member are defined on shoulders of the first blade member and the second blade member, respectively. In some embodiments, the first blade member includes a first blade along an external edge of the first blade member that protrudes from the body and the second blade member includes a second blade along an external edge of the second blade member that protrudes from the body.

In some embodiments, the first blade member protrudes from a first side of the body and the second blade member protrudes from a second side of the body. In some embodiments, the first blade member includes a first locking surface and the second blade member includes a second locking surface. The first locking surface and the second locking surface are configured to abut a portion of the body proximate the member when the first blade member and the second blade member are transitioned into the deployed positions to limit movement of the first blade member and the second blade member out of the deployed positions. In some embodiments, the member is configured to be received within the first recess of the first blade member and the second recess of the second blade member when the first recess and the second recess are aligned with each other when the first blade member and the second blade member are in the retracted positions.

Another embodiment of the present disclosure is a broadhead. The broadhead includes a body, a blade member, and a retainer. The body defines a target penetrating end. The blade member is positioned partially within an inner volume of the body and is configured to rotate and translate relative to the body by a pin that is fixedly coupled with the body being received through a slot of the blade member. The blade member is transitionable between a retracted position and a deployed position. The retainer is bias by a spring in a longitudinal direction towards the target penetrating end. The retainer is configured to be received within a recess of the blade member when the blade member is in the retracted position.

In some embodiments, the broadhead includes a retaining member coupled in a bore of the body at an end of the body opposite the target penetrating end. The retaining member is configured to retain the spring within the bore and also configured to define external threads that protrude from the end of the body opposite the target penetrating end to couple the broadhead with a shaft of an arrow.

In some embodiments, the bore and the inner volume cooperatively form a space within which the retainer and the spring are positioned. In some embodiments, the body includes a first opening on a first side and a second opening on a second side. A bladed edge of the blade member is configured to protrude from the first opening on the first side, and a contact surface of the blade member configured to protrude from the second opening on the second side when the blade member is in the retracted position.

In some embodiments, the blade member is a first blade member. The broadhead further includes a second blade member. A bladed edge of the second blade member is configured to protrude from the second opening on the second side, and a contact surface of the second blade member is configured to protrude from the first opening on the first side.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the FIGURES, which illustrate the exemplary embodiments in detail, it should be understood that the present application is not limited to the details or methodology set forth in the description or illustrated in the FIGURES. It should also be understood that the terminology is for the purpose of description only and should not be regarded as limiting.

Overview

Referring generally to the FIGURES, a broadhead for an arrow includes a body (e.g., a stem) having slots formed on either side and an inner volume. The broadhead also includes blade members that are received within the slots and extend into the inner volume of the body. The blade members include slots. A pin is coupled with the body and extends through the slots. The blade members are rotatable and translatable between a retracted position and a fully expanded or deployed position. The blade members include a notch on a rear surface that is configured to be engaged by a longitudinally translatable member that is positioned within the inner volume of the body. The translatable member is bias towards a target penetrating end of the body such that the translatable member is received within the notches of the blade members when the blade members are in the retracted position. When the broadhead strikes a target, the translatable member may be driven by movement of the blade members to retract, thereby allowing the blade members to transition into the fully expanded or deployed position as the broadhead penetrates the target. Advantageously, the broadhead provides a robust way to retain the blade members in the retracted position during flight and also allows for easy reset and re-use of the broadhead.

Arrow

Figure 1:
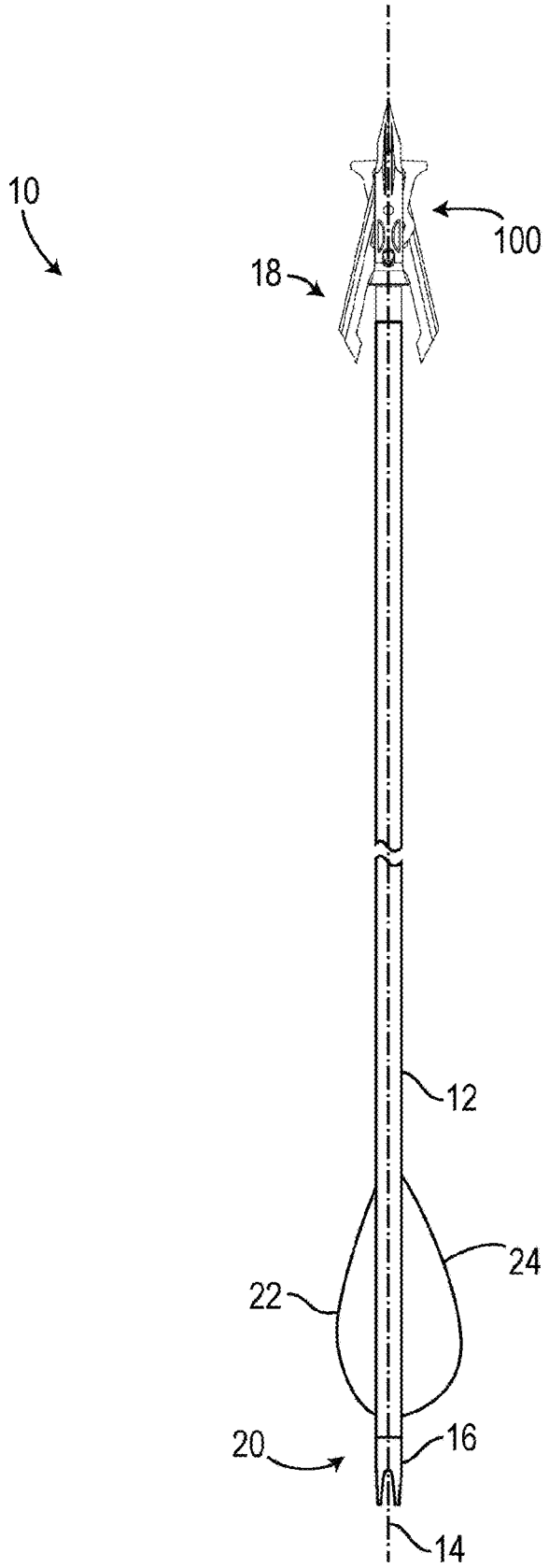
FIG. 1 is a side view of an arrow, according to an exemplary embodiment.

Referring to FIG. 1, an arrow 10 includes a shaft 12 (e.g., an elongated member, a cylindrical member, etc.) that defines a longitudinal axis 14, a nock 16, first fletchings 22 (e.g., hens), and a second fletching 24 (e.g., a cock or index). The shaft 12 includes a first end 18 and a second end 20. The arrow 10 includes a broadhead 100 (e.g., a bullet point, an arrow head, etc.) coupled with the shaft 12 at the first end 18. The nock 16 is coupled with the shaft 12 at the second end 20 and is configured to define a recess to receive a bowstring. The arrow 10 may be usable on a bow, a compound bow, a cross-bow, etc. The broadhead 100 may be threaded onto the shaft 12 at the first end 18.

Broadheads are generally either fixed or expandable. Fixed broadheads have blades fixed in place that do not expand or retract. Expandable broadheads have retractable and expandable blades that are maintained in a retracted position during flight and expand upon impacting a target. While expandable broadheads can provide improved flight stability due to smaller in-flight diameter and improved cut diameter compared to fixed broadheads, expandable broadheads are more complicated which can lead to mechanical failure and non-reusability. Further, mechanical failures in the field may cause expandable broadheads to not expand upon impact with their target or to cause the expandable broadheads to expand prior to impact thereby causing decreased accuracy.

The broadhead 100 advantageously has improved retaining features, and is re-usable. The retaining features of the broadhead 100 facilitate reduced likelihood that the blades will deploy during flight and facilitate ensuring that the blades will expand when hitting the target. Further, the retaining features for the blades of the broadhead 100 allow re-use of the broadhead 100 so that the broadhead 100 can be used multiple times with a straightforward reset (e.g., resetting the broadhead 100 from the expanded state to the retracted state).

Broadhead

Figure 2:
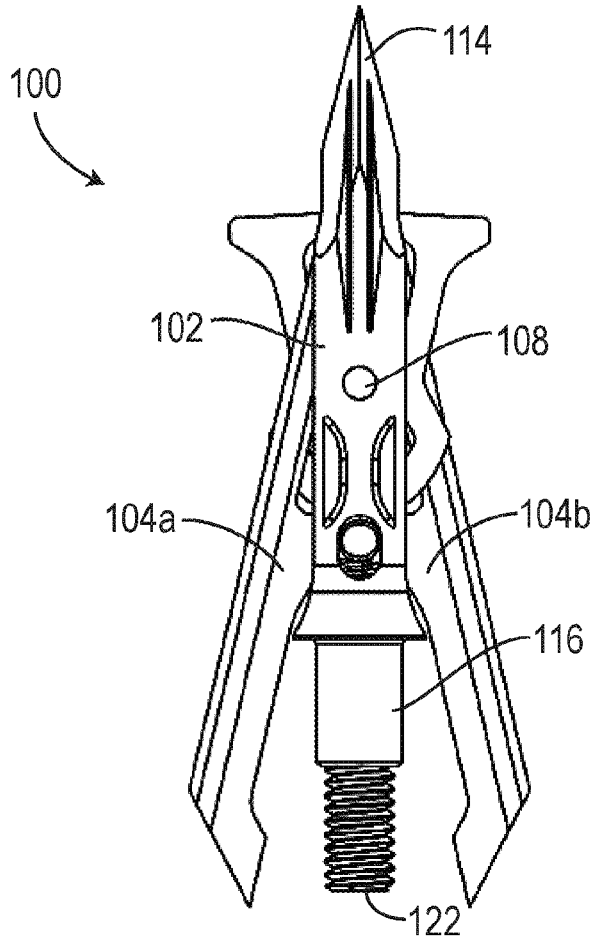
FIG. 2 is a side view of a broadhead of the arrow of FIG. 1 in a retracted state, according to an exemplary embodiment.
Figure 3:
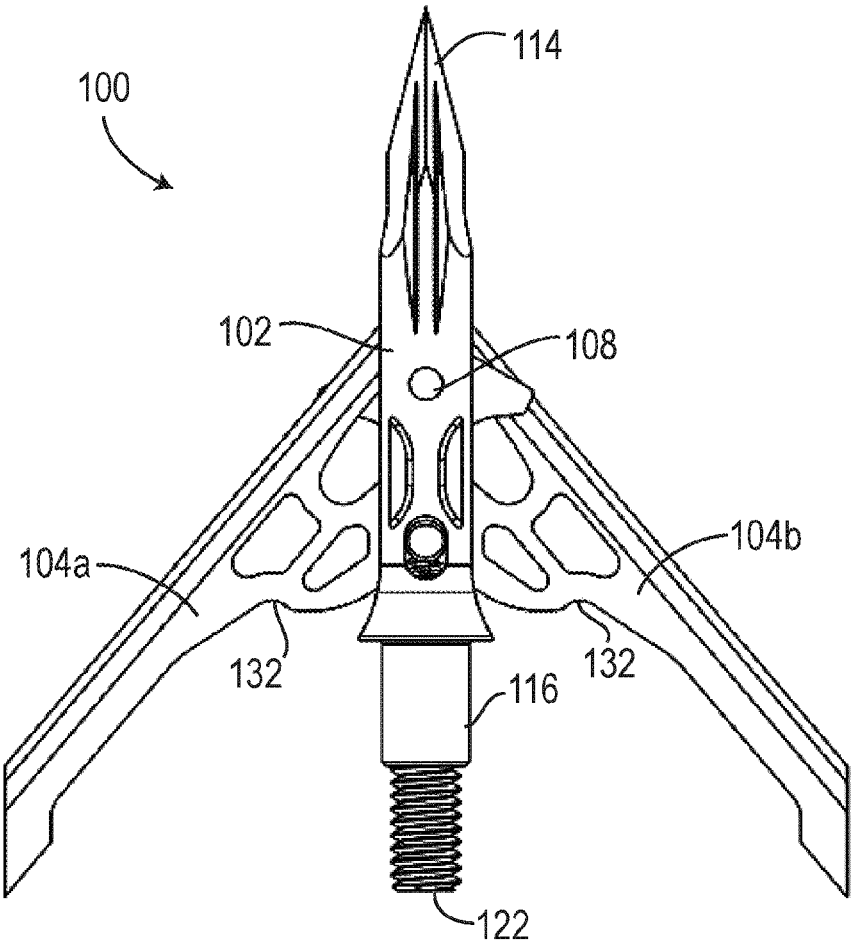
FIG. 3 is a side view of the broadhead of FIG. 2 in an expanded state, according to an exemplary embodiment.

Referring to FIGS. 2-3, the broadhead 100 is shown in a retracted state (FIG. 2) and an expanded state (FIG. 3). The broadhead 100 can be retained in the retracted state shown in FIG. 2 during flight of the arrow 10, and upon contacting a target, be driven to or expand into the expanded state shown in FIG. 3. The broadhead 100 includes a body 102 (e.g., a stem, a main portion, a receiving portion, a frame, etc.) and a pair of blade members 104, shown as first blade member 104*a* and second blade member 104*b*. The body 102 defines a target penetrating end 114 (e.g., a point, a pointed end, a tapered end, etc.) sized and shaped to penetrate into a target upon impact. The target penetrating end 114 may have a point and one or more sharpened surfaces to facilitate penetration of the target.

Figure 9:
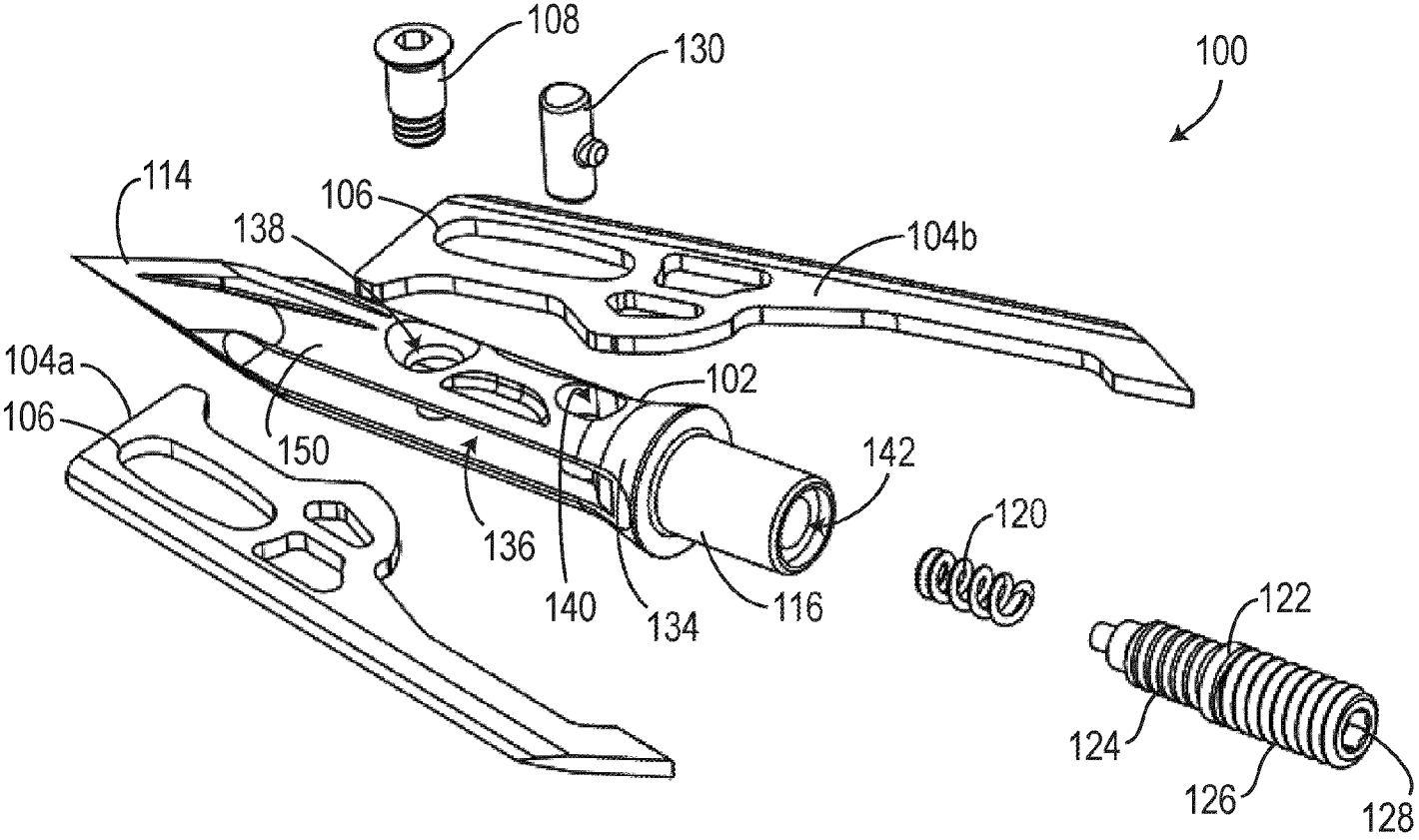
FIG. 9 is a perspective view of the broadhead of FIG. 2 disassembled, according to an exemplary embodiment.

As shown in FIGS. 2-4 and 10, the blade members 104 each include a slot 106 that is formed through a thickness of the blade members 104. The blade members 104 include a blade 162 (e.g., a bladed edge, a sharp edge, etc.) formed on a first side 164 of the blade member 104. The slot 106 is positioned proximate a first end 146 of the blade member 104. The blade member 104 also includes a second end 148 opposite the first end 146. As shown in FIG. 9, the body 102 includes an inner volume 136 having openings defined on opposite sides of the body 102 through which the blade members 104 extend. The body 102 also includes a pin 108 that is received within an opening 138 of the body 102. The pin 108 extends through the inner volume 136 of the body 102 and extends through the slots 106 of the blade members 104. The inner volume 136 is accessible from opposite lateral sides of the body 102 through the openings.

As shown in FIGS. 4-9, the pin 108 is received within the slots 106 of the blade members 104 and defines a pivot point for the blade members 104 to rotate and partially translate along when transitioning from the retracted to the expanded state. The broadhead 100 also includes a plunger 130 (e.g., an engagement member, a tab, a protrusion, etc.) that is received within an opening 140 of the body 102. The opening 138 and the opening 140 generally extend parallel with each other and are disposed at different longitudinal positions along the body 102. Specifically, the opening 138 through which the pin 108 is received is more proximate the target penetrating end 114 of the body 102 than the opening 140 which is positioned proximate an opposite end of the body 102. The opening 138 and the pin 108 may be positioned substantially halfway along a longitudinal length of the inner volume 136. The opening 140 and the plunger 130 are positioned proximate an end of the body 102 that is opposite the target penetrating end 114 (e.g., an end of the broadhead 100 that couples with the shaft 12).

The plunger 130 is received within the opening 140 which may have the form of a slot in order to allow longitudinal movement of the plunger 130 along the slot (e.g., to allow the plunger 130 to move longitudinally along the body 102). The body 102 also includes a bore 142 that extends longitudinally through the end of the body 102 opposite the target penetrating end 114. The body 102 generally includes a cylindrical sidewall 116, a chamfered or frustoconical portion 134, a main portion 150, and the target penetrating end 114. The bore 142 extends through the cylindrical sidewall 116 and the chamfered portion 134. The inner volume 136 and the slots on opposite sides of the body 102 are generally formed or defined by the main portion 150. The bore 142 and the inner volume 136 form a unitary space such that the inner volume 136 is accessible through the bore 142. The opening 140 (e.g., the slot) is formed through the main portion 150 at a position at the end of the bore 142. The opening 140 and the opening 138 extend generally perpendicular to a direction of the openings of the inner volume 136 on opposite sides of the main portion 150 through which the blade members 104 extend.

The broadhead 100 also includes a spring 120 (e.g., a compressive member, a resilient member, etc.) that is received within the bore 142. The spring 120 is positioned within the bore 142 and engages the plunger 130 (e.g., a retaining member, a biased member, etc.) in order to bias the plunger 130 in the longitudinal direction towards the target penetrating end 114 of the broadhead 100. The broadhead 100 also includes a retaining member 122 (e.g., a cap, a removable ferrule, a removable threaded end cap, a threaded member). The retaining member 122 is configured to be threaded into the cylindrical portion 116 and includes first threads 124 that engage with threads formed along an inner wall of the cylindrical portion 116 at the bore 142. The retaining member 122 also includes second threads 126 that, when the retaining member 122 is threaded into the bore 142, protrude outwards and are configured to couple the broadhead 100 with the shaft 12 of the arrow 10. In this way, the retaining member 122 functions to both provide a reactionary surface for the spring 120 and also to couple the broadhead with the shaft 12 of the arrow 10. The retaining member 122 includes a tool interface 128 (e.g., a hex interface, a hexagonal opening, a screw driver interface, etc.) in order to facilitate threading the retaining member 122 into the bore 142. It should be understood that the retaining member 122 may be coupled with the body 102 via other means such as through fasteners, a compression fit, etc.

Figure 4:
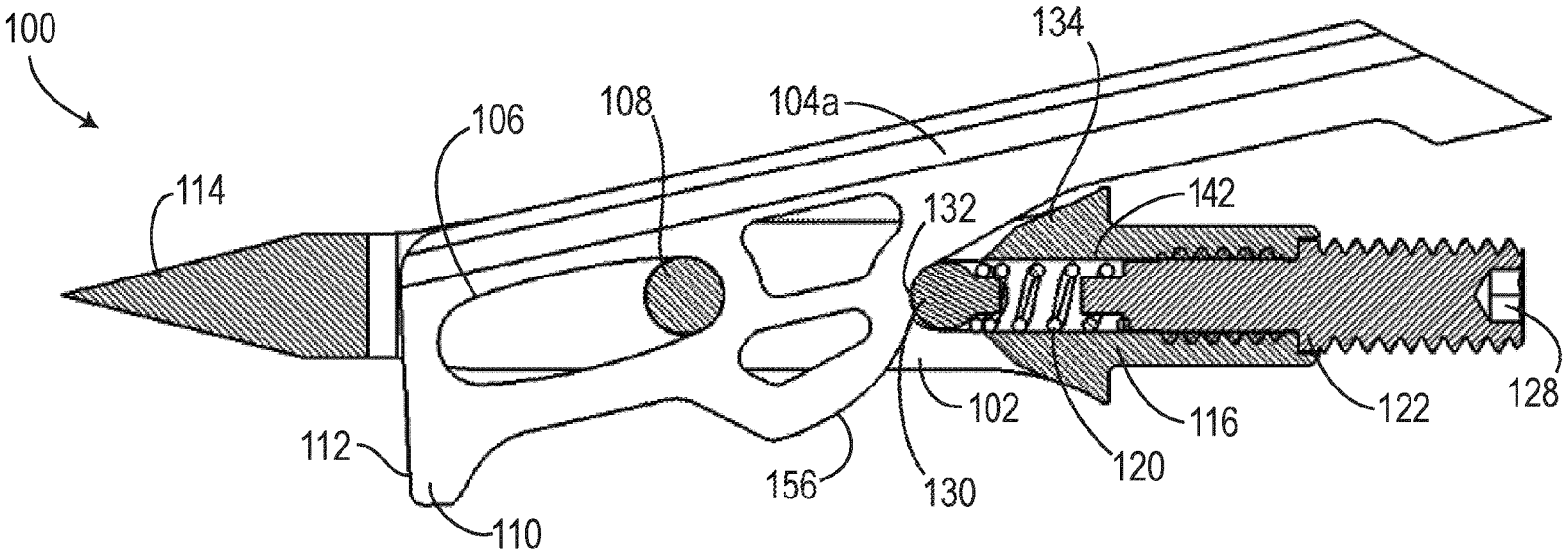
FIG. 4 is a side sectional view of the broadhead of FIG. 2 in the retracted state, according to an exemplary embodiment.

As shown in FIG. 4, the spring 120 is configured to engage the plunger 130 and bias the plunger 130 into engagement with a corresponding notch 132 (e.g., a recess, a groove, a shoulder, etc.) of the blade members 104. The notch 132 has a shape corresponding to an outer periphery of the plunger 130 such that the plunger 130 can be received within the notch 132. When the plunger 130 is received within the notch 132, the blade member 104 is maintained in the retracted state or position with the pin 108 at a first end of the slot 106 and the blade member 104 is limited from transitioning into the expanded or deployed state or position. The spring 120 advantageously biases the plunger 130 into a position towards the target penetrating end 114 of the body 102 such that the plunger 130 is received within the notch 132 and retains the blade members 104 in the retracted position (e.g., during aiming and flight of the broadhead 100). As shown in FIG. 2, the plunger 130 is configured to engage the notch 132 of both blades 104 in order to retain the blades 104 in the retracted position. The plunger 130 can function as a detent mechanism in order to requires a baseline amount of force to be applied to the blades 104 to cause the spring 120 to retract. The plunger 130 can be biased into engagement or reception of the notches 132 of both blades 104 when the blades 104 are both in the retracted position and the notches 132 align.

Figure 10:
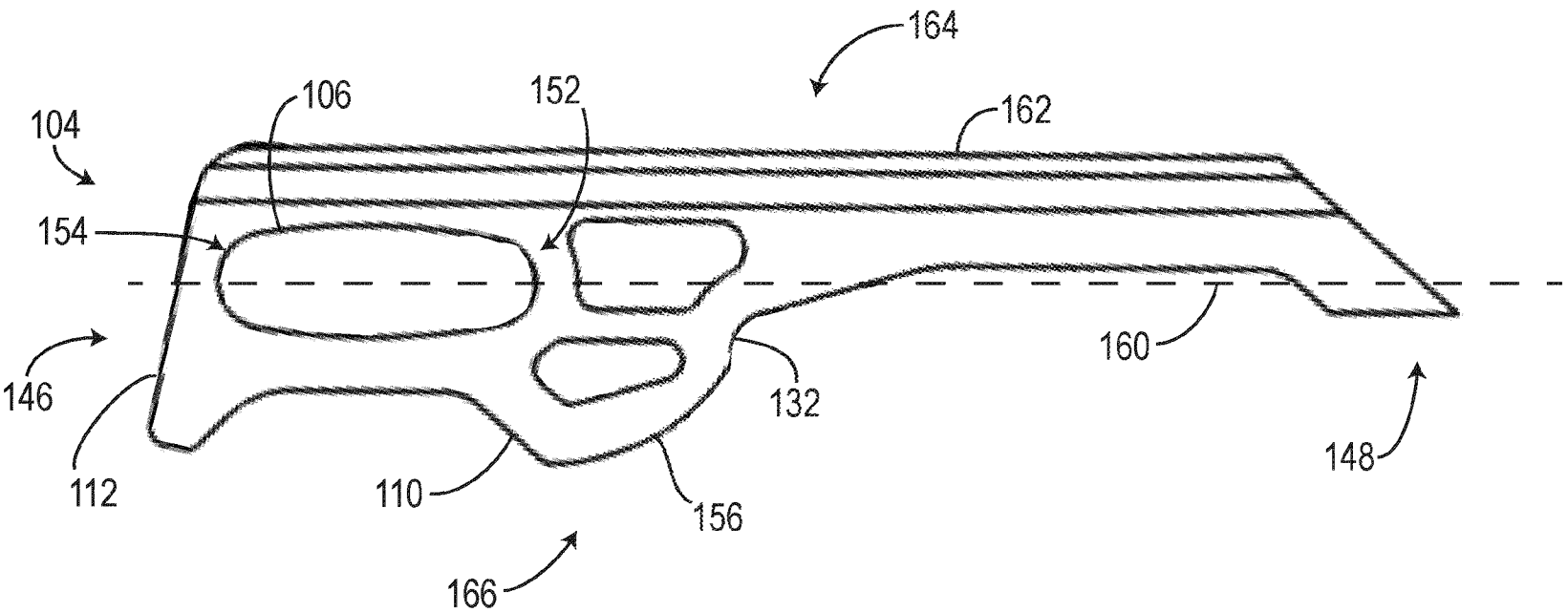
FIG. 10 is a side view of a blade member of the broadhead of FIG. 2, according to an exemplary embodiment.
Figure 11:
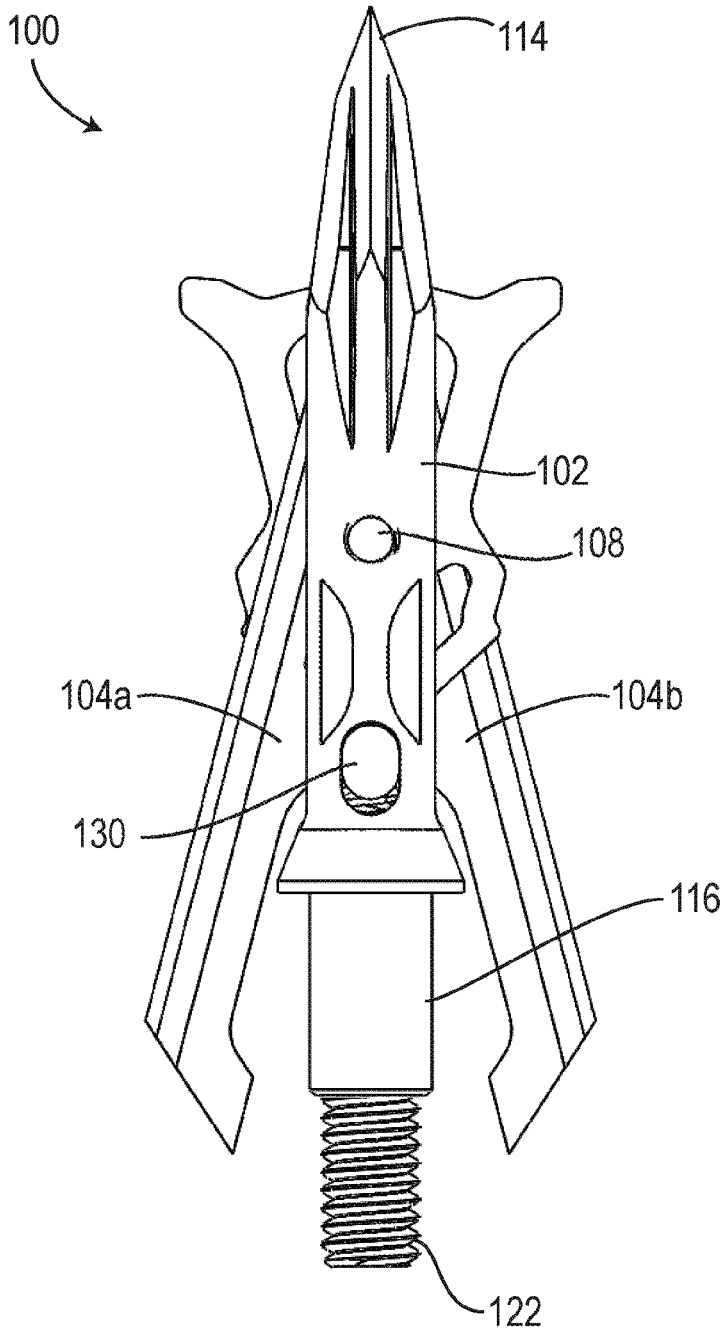
FIG. 11 is a side view of another embodiment of the broadhead of FIG. 2, according to an exemplary embodiment.

Referring particularly to FIG. 10, the slot 106 is formed laterally within the blade member 104 at a position between the first side 164 and the second side 166. The notch 132, an engagement surface 156, and a locking surface 110 are defined on the second side 166 of the blade member 104. The first end 146 includes a contact surface 112 that is configured to protrude from the body 102 when the broadhead 100 is assembled and be contacted or engaged by the target when the broadhead 100 hits the target. The slot 106 may define a longitudinal centerline 160 (e.g., an axis, a dimension, a direction) of the blade member 104. The slot 106 includes a first end 152 and a second end 154 opposite the first end 152. The first end 152 and the second end 154 may be rounded or have a radius or diameter corresponding to the radius or diameter of the pin 108. The slot 106 can define different pivot points at the first end 152 and the second end 154 about which the blade member 104 is configured to rotate during deployment. The blade member 104 may also be configured to translate longitudinally (e.g., in a direction parallel with the longitudinal centerline 160). The notch 132, the engagement surface 156, and the locking surface 110 may form a protrusion that protrudes outwards from the longitudinal centerline 160 on the second side 166 of the blade member 104. The contact surface 112 may be formed on a protrusion at a corner of the first end 146 and the second side 166 that extends outwards from the longitudinal centerline 160 in order to provide a moment arm about the pivot points defined by the slot 106 (e.g., about the pin 108).

Figure 5:
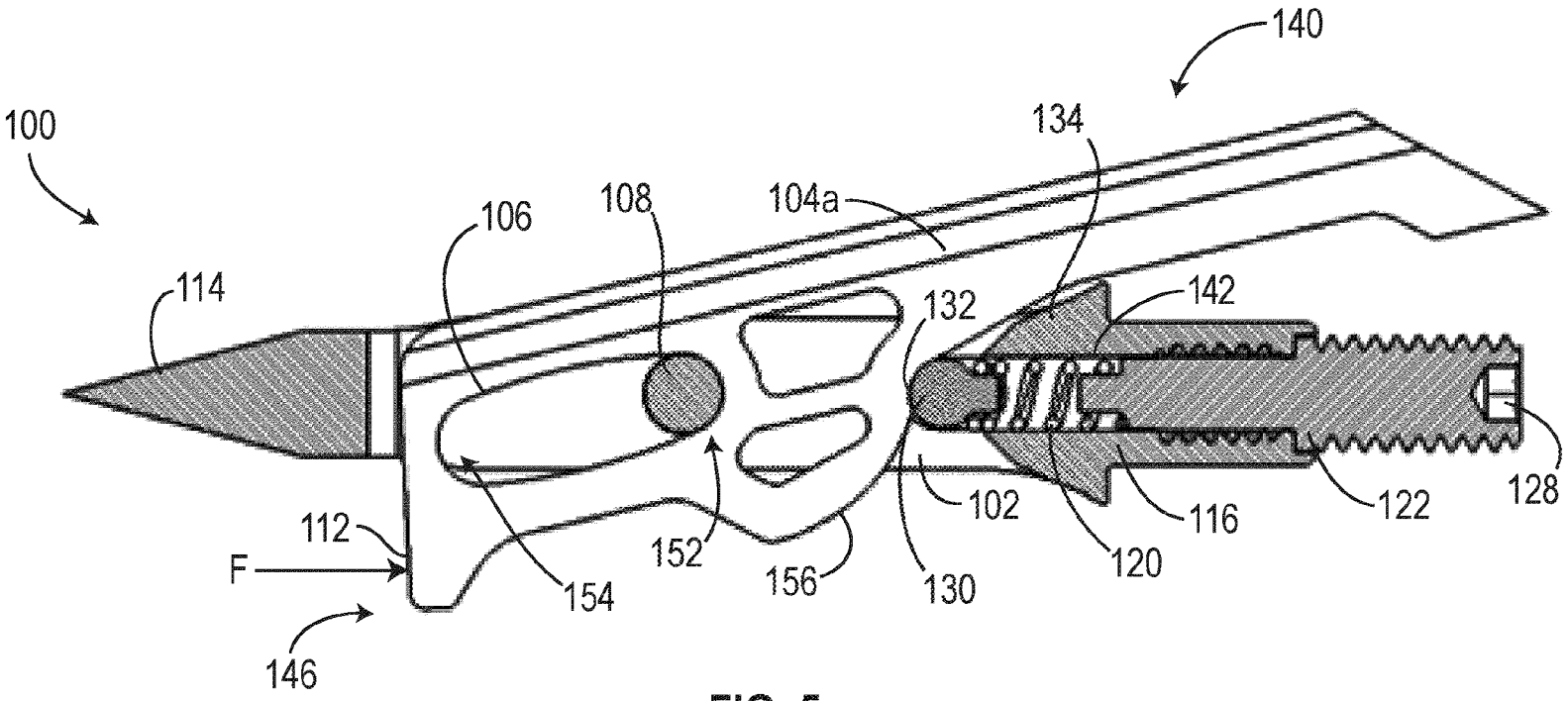
FIG. 5 is a side sectional view of the broadhead of FIG. 2 in a partially expanded state, according to an exemplary embodiment.
Figure 6:
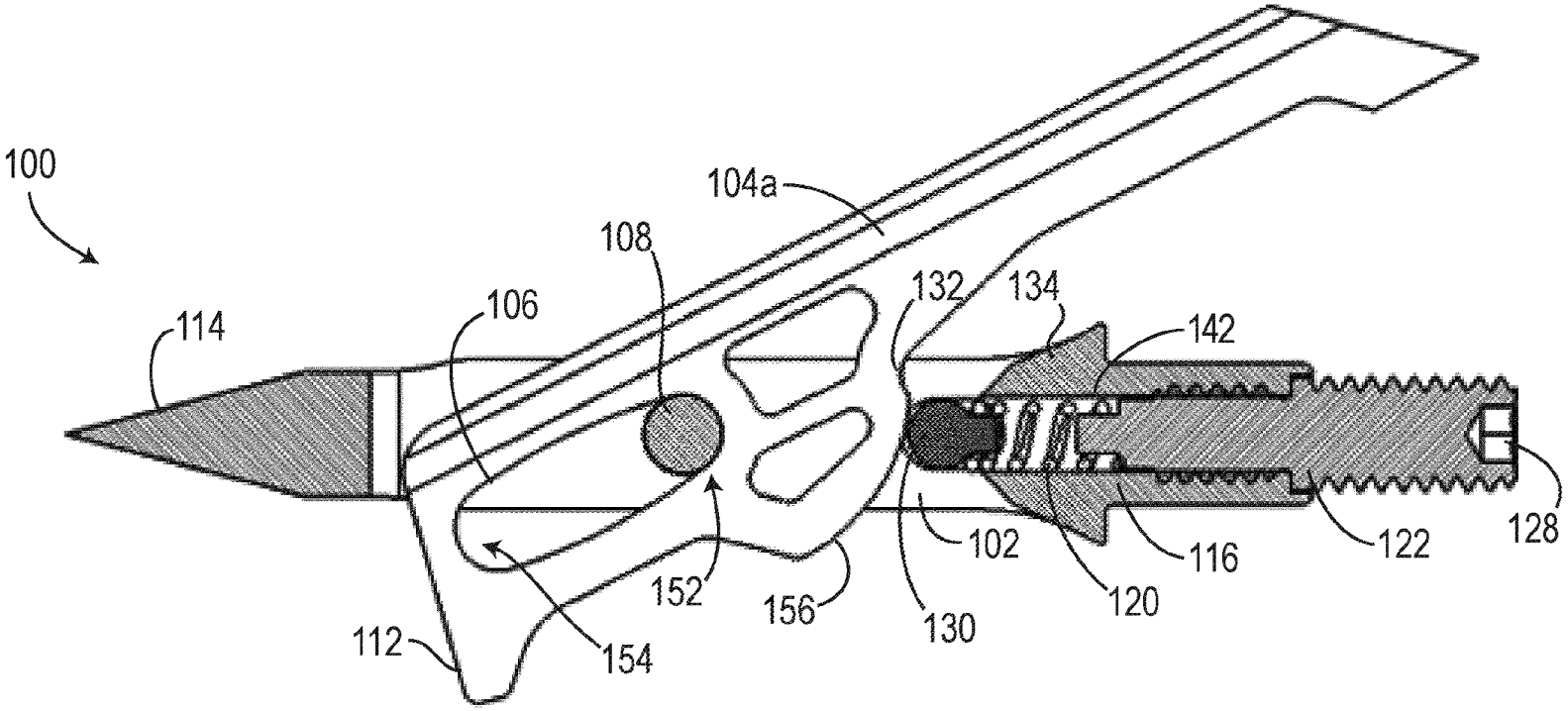
FIG. 6 is a side sectional view of the broadhead of FIG. 2 in another partially expanded state, according to an exemplary embodiment.
Figure 7:
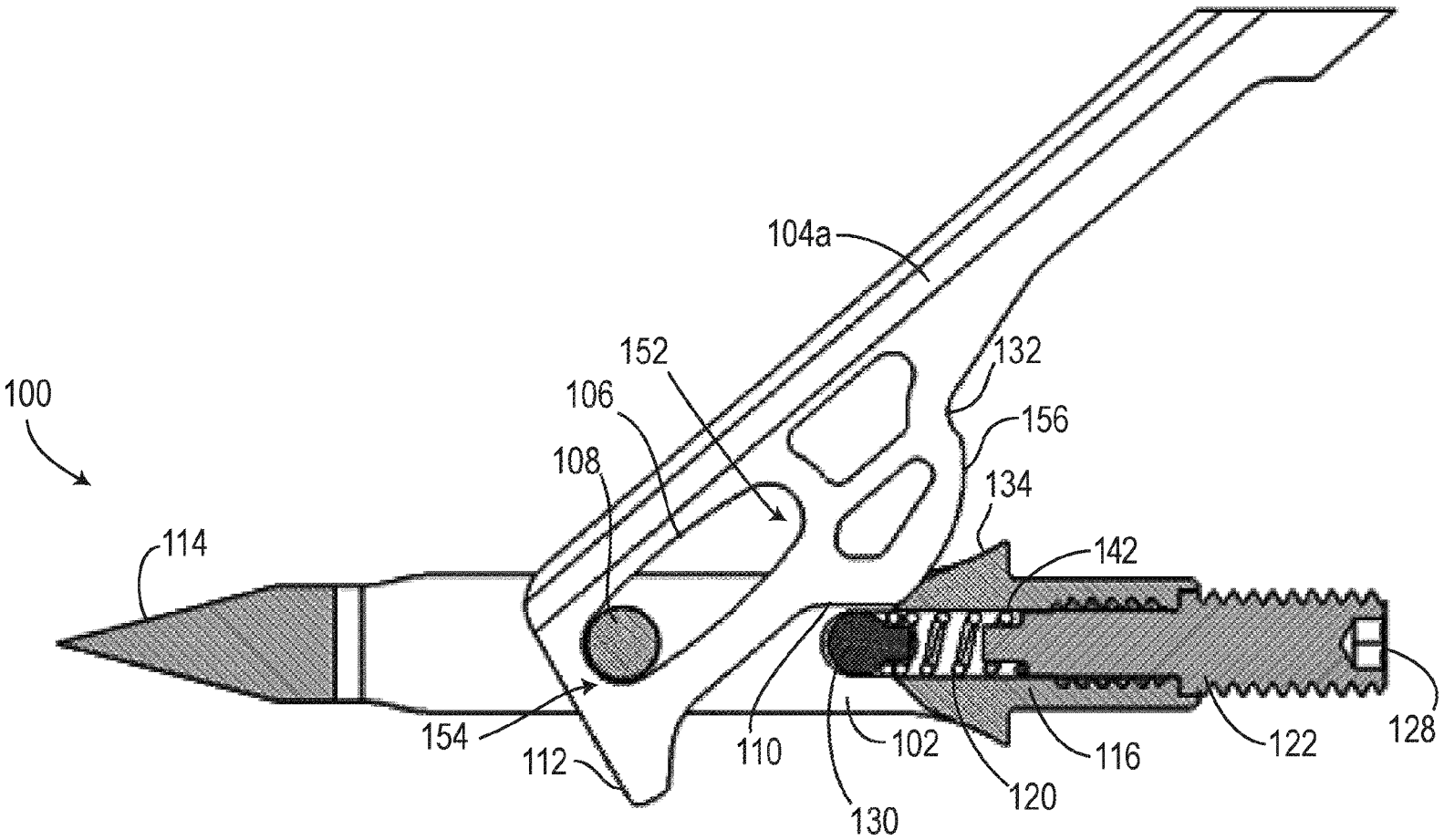
FIG. 7 is a side sectional view of the broadhead of FIG. 2 in the expanded state, according to an exemplary embodiment.

Referring to FIGS. 5-7 and 10, the deployment of the blade member 104 is shown from fully retracted or stowed (FIG. 5) to partially deployed (FIG. 6) to fully deployed (FIG. 7). It should be understood that while FIGS. 5-7 as described herein are with reference to only one of the blade member 104, the same description can apply to the configuration, arrangement, and deployment of both blade members 104*a* and 104*b*, which may both be installed on the broadhead 100 in mirrored arrangements.

When the blade member 104 is in the retracted or stowed position, shown in FIG. 5, the plunger 130 is received within the notch 132. The pin 108 is received within the slot 106 and is positioned at the first end 152 of the slot 106. The spring 120 biases the plunger 130 into engagement with the blade member 104 at the notch 132 and holds the blade member 104 in place. The blade member 104 may be pushed or biased by the plunger 130 into contacting the pin 108 at the first end 152 of the slot 106 and contacting a surface of the body 102 at the target penetrating end 114. In particular, a portion of the contact surface 112 or a corner between the first end 146 and the first side 164 may contact a portion of the body 102 at the target penetrating end 114 of the broadhead 100. The broadhead 100 may be retained in the retracted or stowed position during flight of the arrow 10. When the target penetrating end 114 of the broadhead 100 strikes the target and is driven into the target due to inertia of the arrow 10, the contact surface 112 of the broadhead 100 contacts the target, which causes a force F to be exerted on the blade member 104. The force F is applied to the blade member 104 in a direction that opposes the direction of expansion of the spring 120. The force F causes the blade member 104 to translate in a rearwards direction (e.g., towards the plunger 130 and away from the target penetrating end 114) which causes the plunger 130 to retract, thereby compressing the spring 120. The force F also produces a moment about the pin 108 that drives the blade member 104 to rotate in a counter-clockwise direction about the pin 108 in the orientation shown in FIG. 5. The moment about the pin 108 and the force F causes the plunger 130 to retract and compress the spring 120, thereby transitioning out of engagement with the notch 132. When the plunger 130 translates out of engagement with the blade member 104 at the notch 132, the blade member 104 may be free to begin to rotate and translate into the expanded position.

Referring to FIG. 6, the blade member 104 is shown in the partially deployed or expanded position. The blade member 104 is still positioned such that the pin 108 is received at the first end 152, but has rotated in the counter-clockwise direction about the pin 108 such that the plunger 130 abuts the engagement surface 156. As the blade member 104 continues to rotate in the counter-clockwise direction about the pin 108 and begins to move rearwards (e.g., in a direction along the slot 106), the plunger 130 may walk along the engagement surface 156.

Referring to FIG. 7, the blade member 104 is shown in the fully expanded or deployed position. When the blade member 104 transitions from the partially or fully retracted position to the fully expanded or deployed position, the blade member 104 may both rotate counter-clockwise about the pin 108 and translate relative to the pin 108. The blade member 104 can be driven by the force F as the broadhead 100 penetrates the target such that the blade member 104 translates rearwards (e.g., away from the target penetrating end 114). The blade member 104 translates such that the pin 108 is positioned at the second end 154 of the slot 106. The blade member 104 may slide back such that the engagement surface 156 of the blade member 104 directly contacts the chamfered portion 134 (e.g., the outer surface of a frustoconical portion of the body 102). The blade member 104 may also translate and rotate into the position shown in FIG. 7 such that the plunger 130 directly contacts, abuts, or is otherwise positioned to engage the locking surface 110. The plunger 130 may facilitate limiting translation and rotation of the blade member 104 from the fully expanded or deployed position back into the retracted position by the engagement between the plunger 130 and the locking surface 110.

In order to re-use the broadhead 100, such as after the arrow 10 is removed from the target, a user may apply a force to a back of the blade members 104 (e.g., at the notch 132) and push the blade member forwards 104 to rotate and translate the blade members 104 out of the fully expanded position shown in FIG. 7, into the position shown in FIG. 6, and then into the fully retracted position shown in FIG. 5. The plunger 130 may then be bias back into both of the notches 132 and retain the blade members 104 in the retracted state for reuse at a later time.

Referring to FIGS. 7 and 9, the retaining member 122 is threadingly coupled into the bore 142 of the body 102 of the broadhead and functions to both hold the spring 120 in place, and to provide a connection point for coupling the broadhead 100 onto the shaft 12 of the arrow 10. The plunger 130 is driven by the spring 120 (e.g., a bias member) to travel in either longitudinal direction along the body 102 of the broadhead to thereby retain or release the blade members 104 during flight and deployment (e.g., upon hitting a target). The bore 142 and the inner volume 136 form a cavity within the body 102 to house the plunger 130 and the spring 120.

Figure 8:
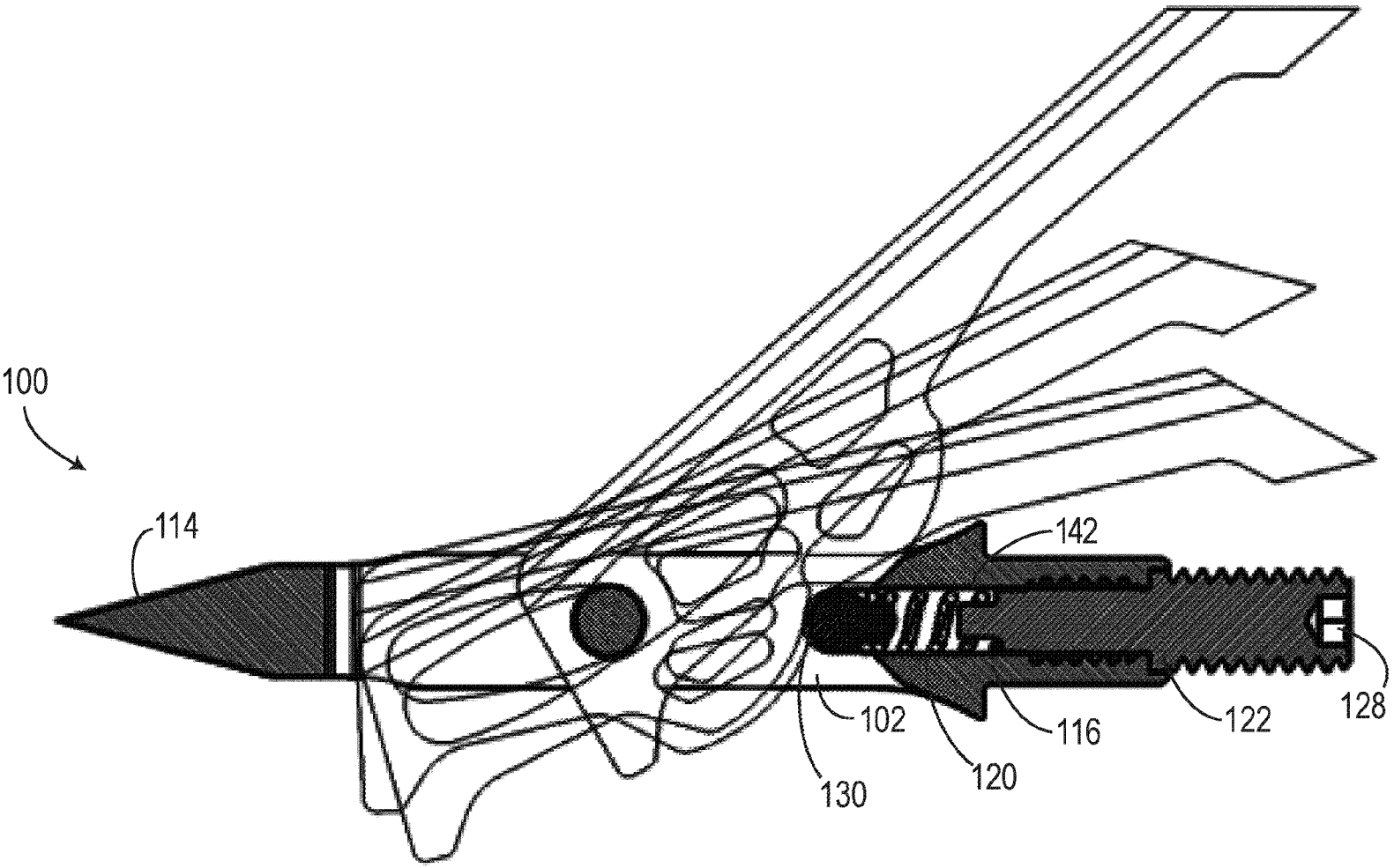
FIG. 8 is side sectional view showing the broadhead of FIG. 2 in different states from retracted to expanded in phantom, according to an exemplary embodiment.

Referring to FIG. 8, the broadhead 100 is shown with the blade members 104 in different degrees of deployment in phantom. The blade members 104 may transition between the fully retracted position and the fully deployed position in order to provide a smaller in-flight diameter and a larger cut diameter upon impact with the target.

Advantageously, the broadhead 100 described herein provides improved retaining ability of the blade members 104 during flight of the arrow 10 such that the blade members 104 are maintained in the retracted state and do not accidentally deploy during flight. The broadhead 100 described herein is also easily re-usable by simply translating the blade members 104 back into their retracted positions after being fully deployed.

Referring to FIGS. 11-15, the broadhead 100 is shown according to another embodiment. As shown in FIGS. 11-15, the broadhead 100 can be functionally similar to the broadhead 100 as described in greater detail above with reference to FIGS. 1-10. The broadhead 100 as described herein with reference to FIGS. 11-15 can include various geometrical differences than the broadhead 100 as described in greater detail above with reference to FIGS. 1-10.

Figure 14:
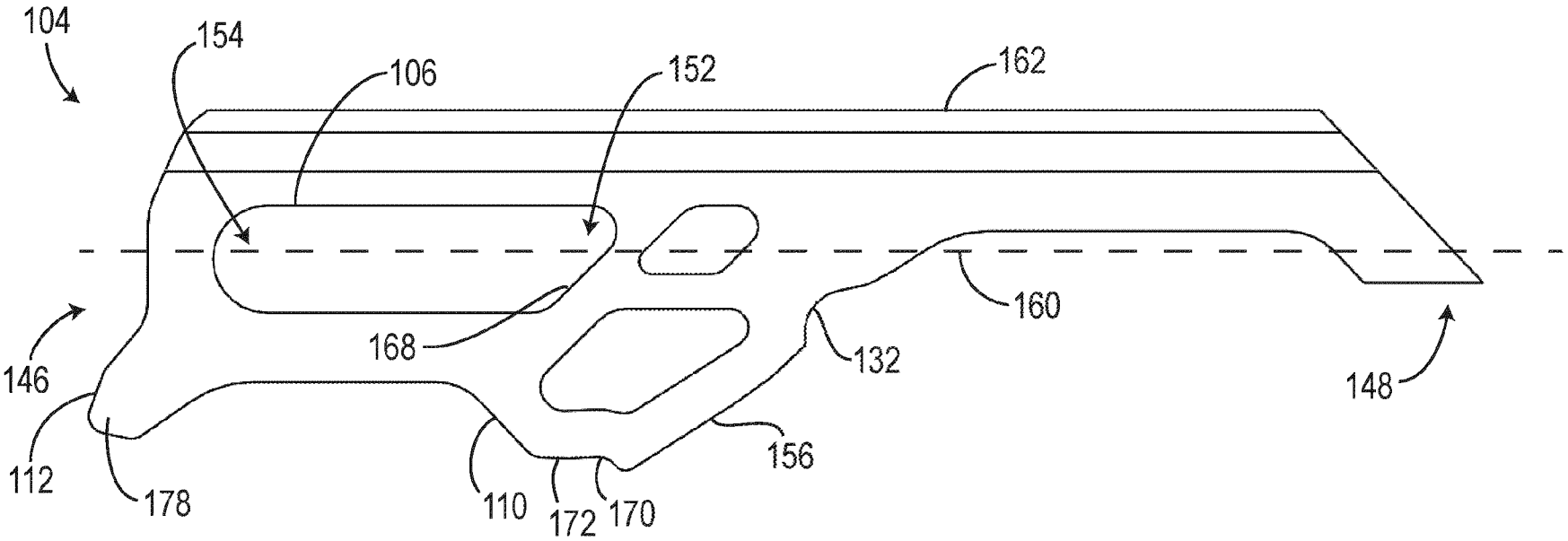
FIG. 14 is a side view of a blade member of the broadhead of FIG. 11, according to an exemplary embodiment.

Referring particularly to FIG. 14, one of the blade members 104 is shown. It should be understood that both of the blade members 104 as described herein with reference to FIGS. 11-15 can have the same geometry as described herein with reference to FIG. 14.

The blade member 104 includes similar overall geometry as the blade members 104 described in greater detail above with reference to FIG. 10. The first end 152 of the slot 106 can include an angled surface 168 as opposed to a curved surface as described above with reference to FIG. 10. The angled surface 168 can extend towards the blade 162 and rearwards towards the second end 148 of the blade member 104. The angled surface 168 facilitates engagement of the pin 108 in order to retain the blade member 104 in the retracted position (e.g., as shown in FIG. 12).

Figure 15:
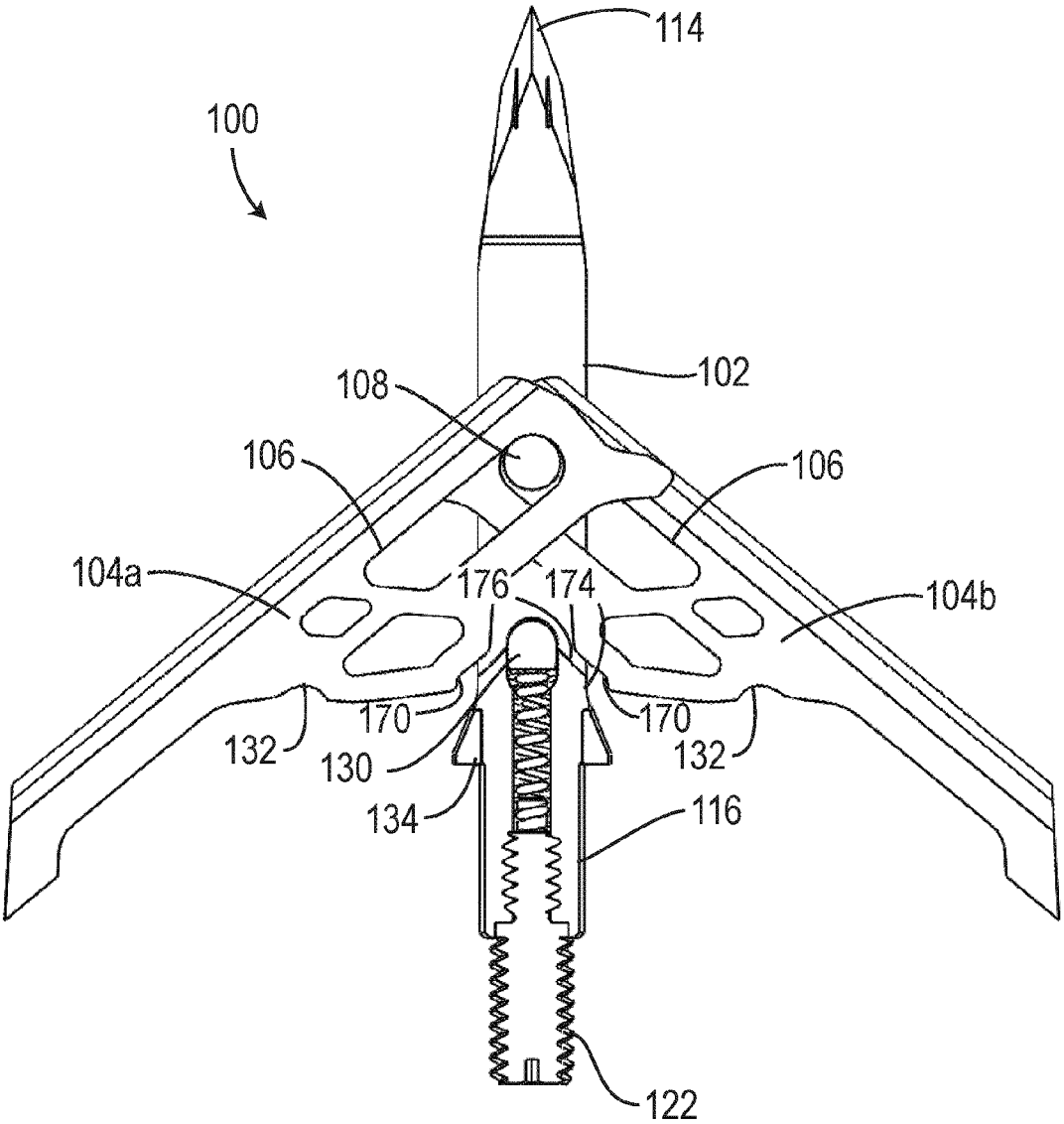
FIG. 15 is a side sectional view of the broadhead of FIG. 11 in an expanded position, according to an exemplary embodiment.

As shown in FIG. 14, the blade member 104 also includes the notch 132 formed along a continuous edge as opposed to at a shoulder between the engagement surface 156 and an adjacent surface. The engagement surface 156 has a generally straight and angled shape as opposed to a rounded or curved shape as shown and described in greater detail above with reference to FIG. 10. The blade member 104 also includes a shoulder 170 defined between an intermediate edge 172 and the engagement surface 156. The intermediate edge 172 is generally straight and defines a surface configured to engage an outer surface of the frustoconical portion 134 of the body 102. The shoulder 170 can have the form of an angle with a rounded interior edge that corresponds in shape to an external shoulder of the frustoconical portion 134 (e.g., as shown in FIG. 15). The shoulder 170 and the intermediate edge 172 can therefore facilitate engagement between the blade member 104 and the frustoconical portion 134 of the body 102.

Figure 12:
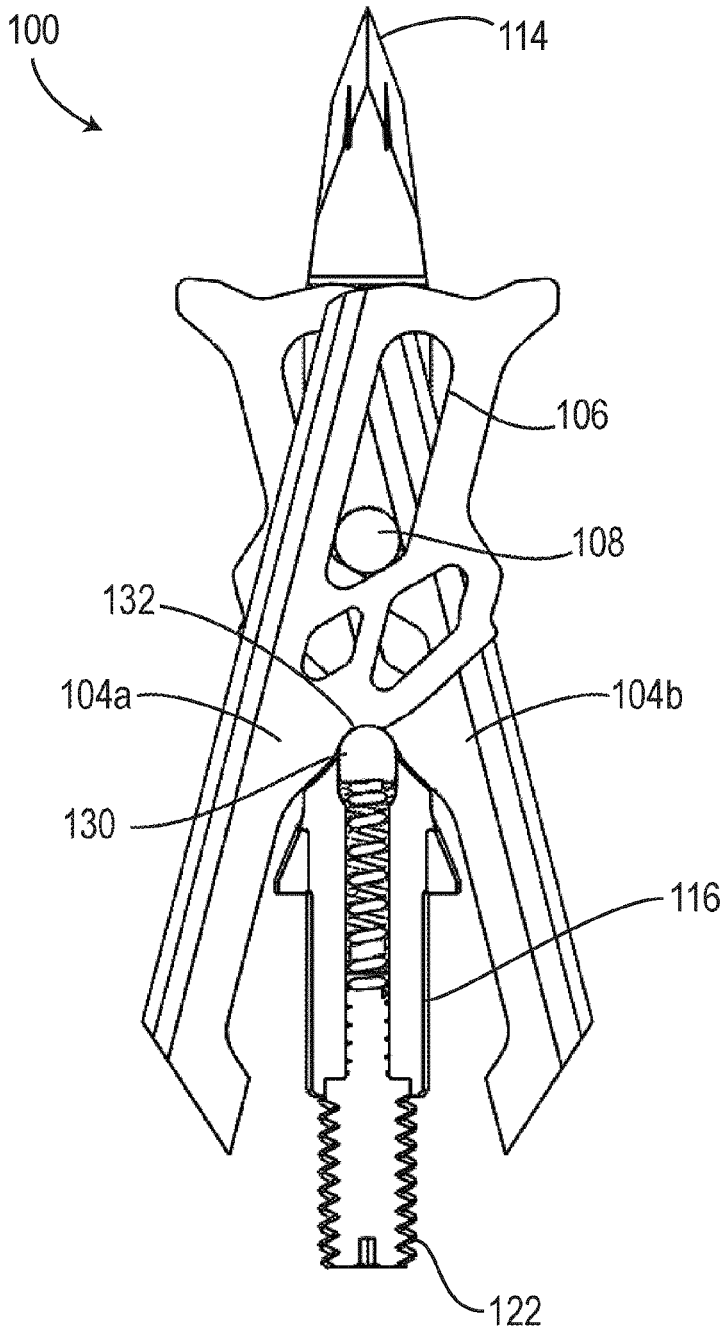
FIG. 12 is a side sectional view of the broadhead of FIG. 11 in a retracted position, according to an exemplary embodiment.
Figure 13:
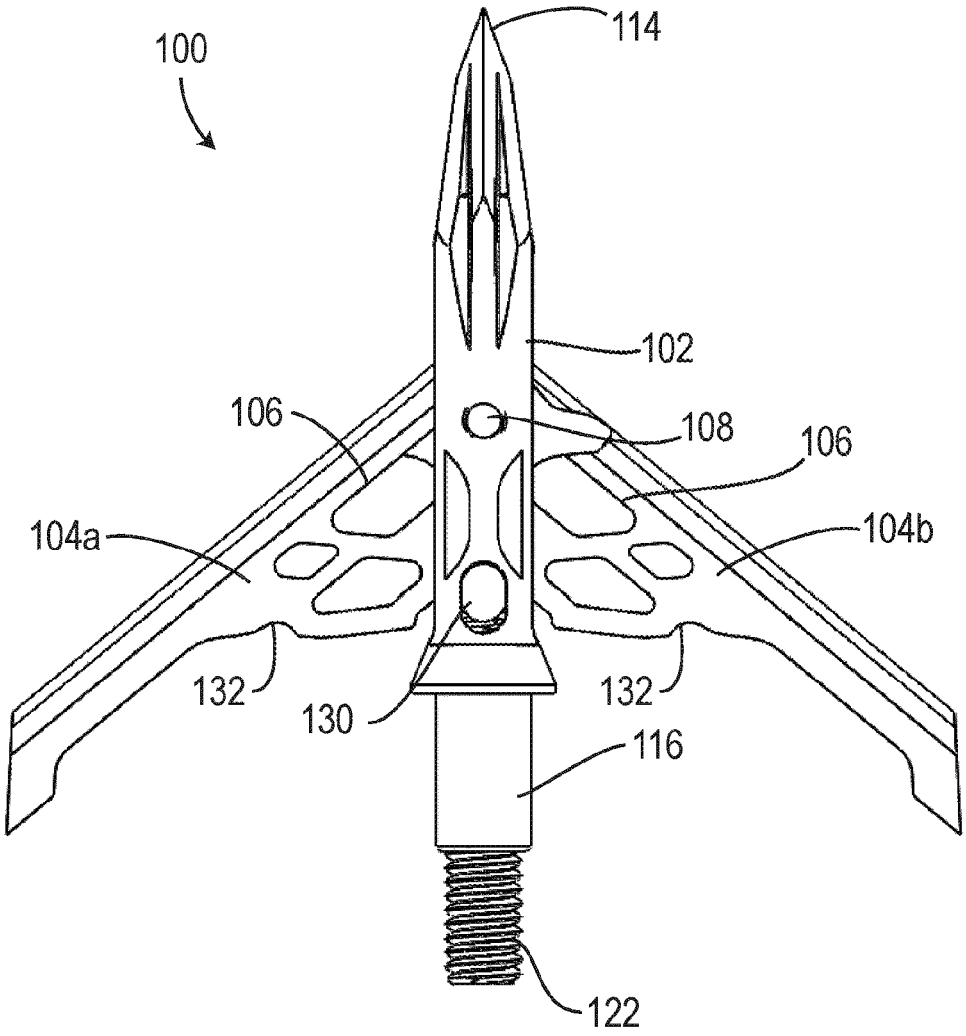
FIG. 13 is a side view of the broadhead of FIG. 11 in an expanded position, according to an exemplary embodiment.

As shown in FIGS. 12 and 15, the frustoconical portion 134 includes a first surface 174 that extends in the longitudinal direction (e.g., a straight surface) and an angled surface 176 that extends inwards from the first surface 174. The first surface 174 and the angled surface 176 can define an angle or shoulder therebetween that corresponds in shape to the shoulder 170 of the blade member 104. The frustoconical portion 134 of the body 102 is therefore configured to engage and be received within the shoulder 170 of the blade members 104 when the blade members 104 are in the deployed position as shown in FIG. 15. The engagement between the frustoconical portion 134 and the shoulder 170 of the blade member facilitates limiting movement of the blade members 104 out of the deployed position.

As shown in FIG. 14, the contact surface 112 can be defined on a protrusion 178 that extends in the longitudinal direction (e.g., in a direction parallel with the longitudinal centerline 160). The protrusion 178 and the contact surface 112 can extend in a forwards direction towards the target penetrating end 114 of the broadhead 100 (e.g., as shown in FIG. 12) when the blade members 104 are installed on the body 102. The protrusions 178, as shown in FIG. 12, can be the first portion of the blade members 104 that contact the target as the target penetrating end 114 of the broadhead 100 penetrates the target. The protrusions 178 therefore shift the contact surface 112 forwards and more proximate the target penetrating end 114 in order to improve deployment of the blade members 104 (e.g., to transition the blade members 104 out of the stowed position and into the fully deployed position).

Figure 16:
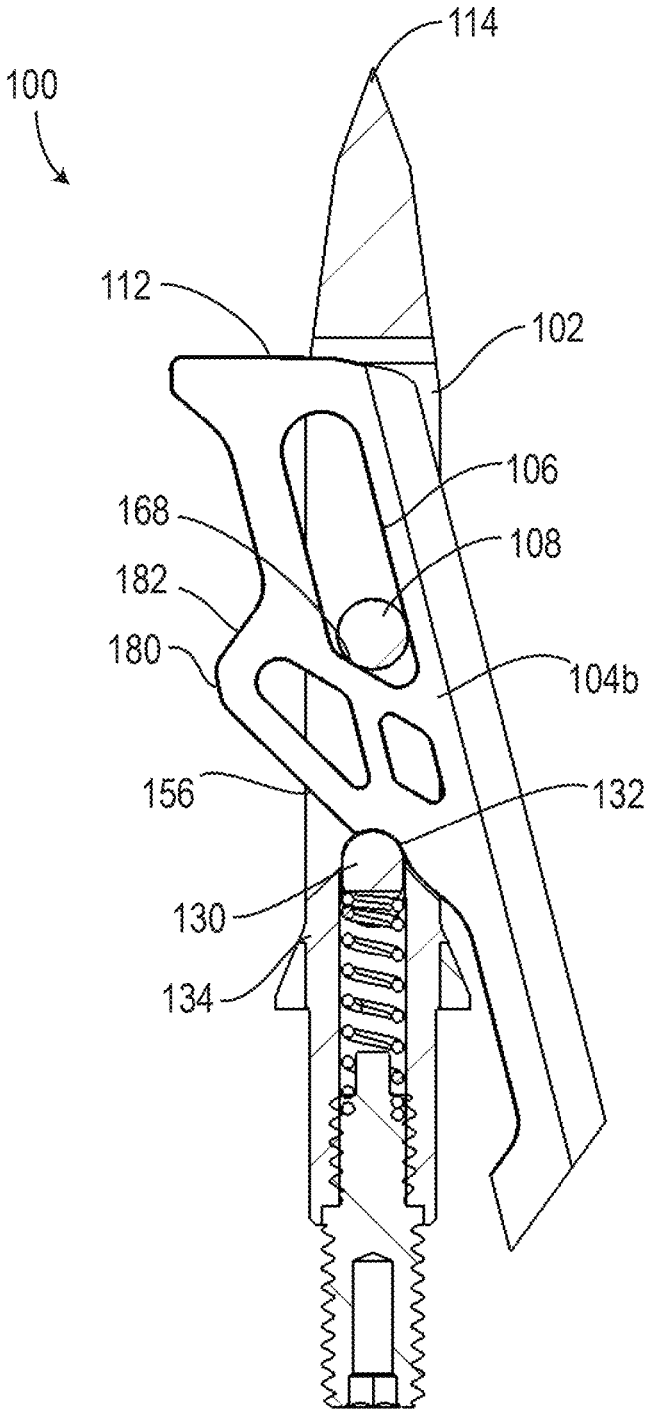
FIG. 16 is a side sectional view of the broadhead of FIG. 2 with another embodiment of a blade member in a retracted position, according to another exemplary embodiment.
Figure 17:
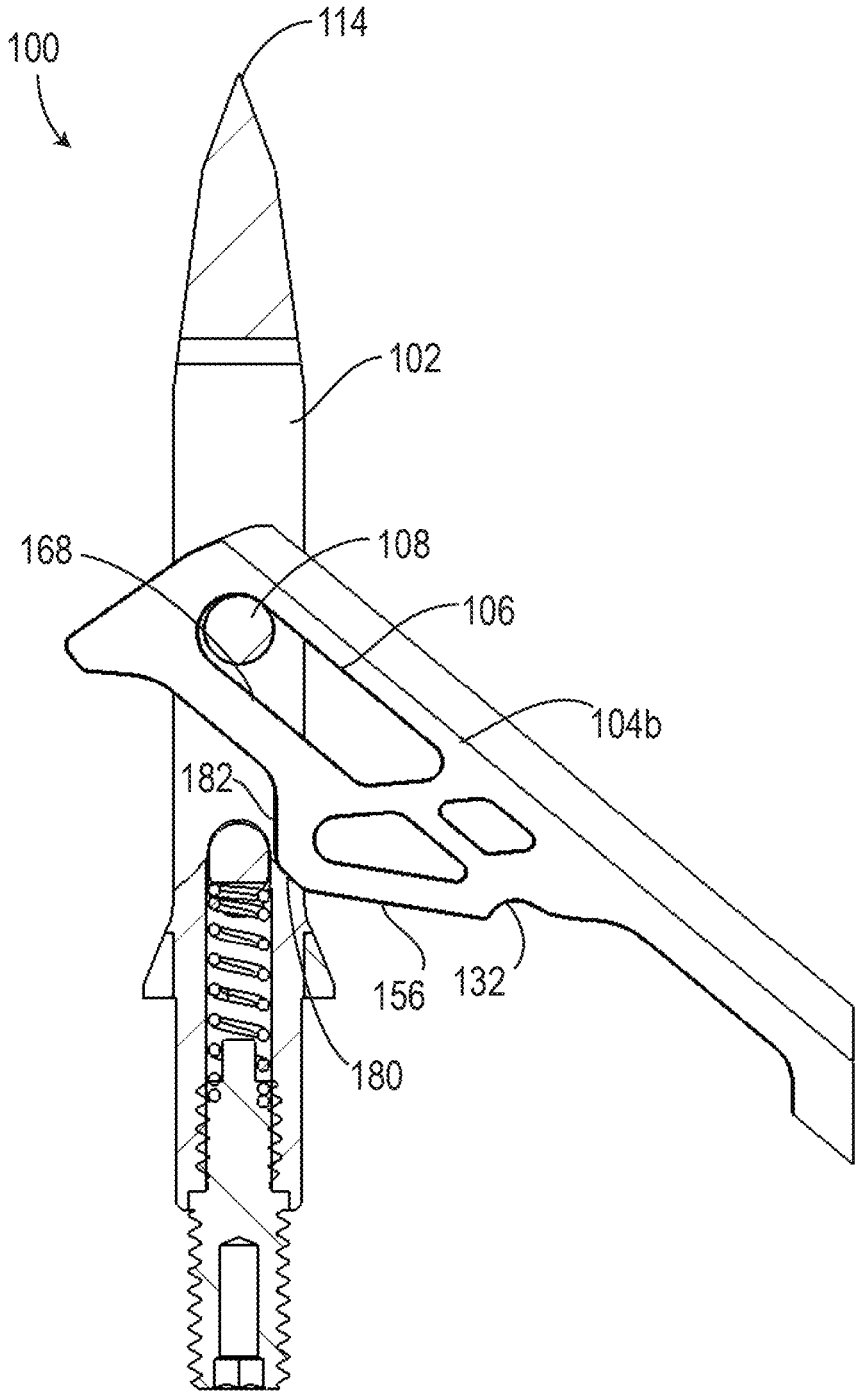
FIG. 17 is a side sectional view of the broadhead of FIG. 16 with the blade member in a deployed position, according to an exemplary embodiment.
Figure 18:
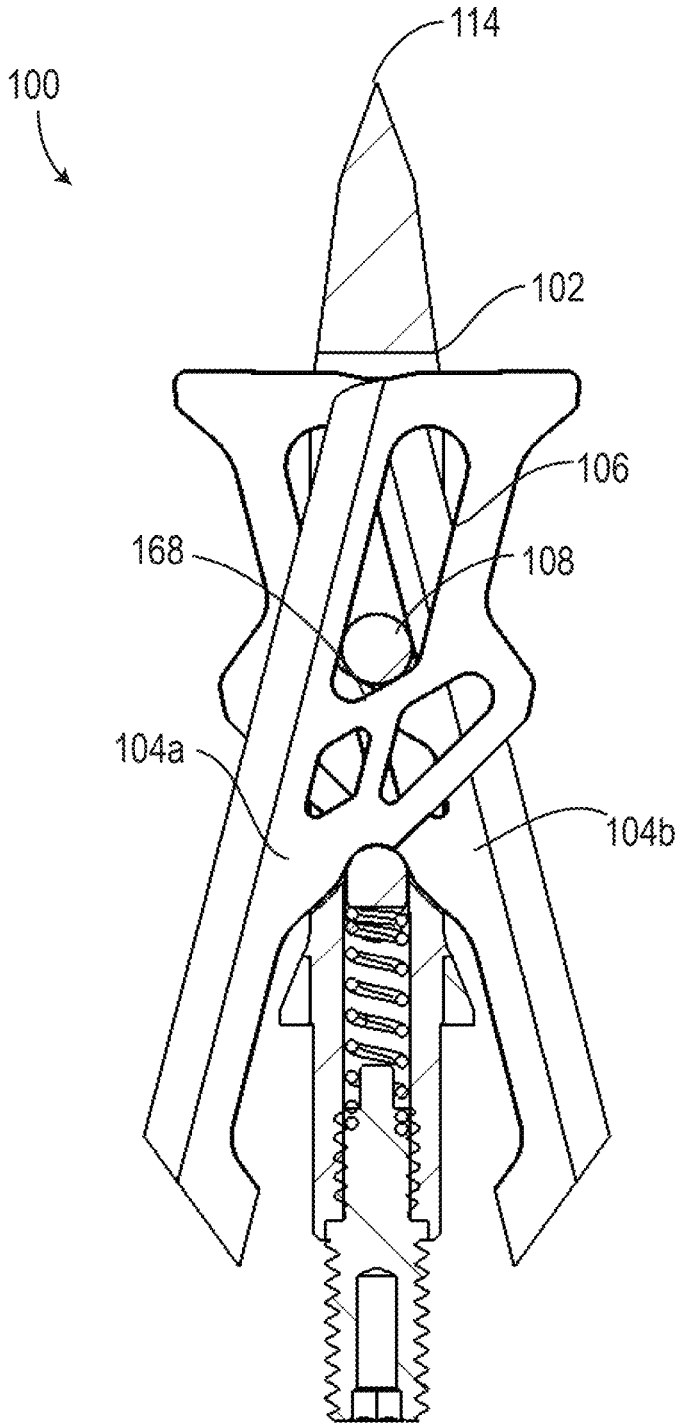
FIG. 18 is a side sectional view of the broadhead of FIG. 16 including a pair of the blade members in the retracted position, according to an exemplary embodiment.
Figure 19:
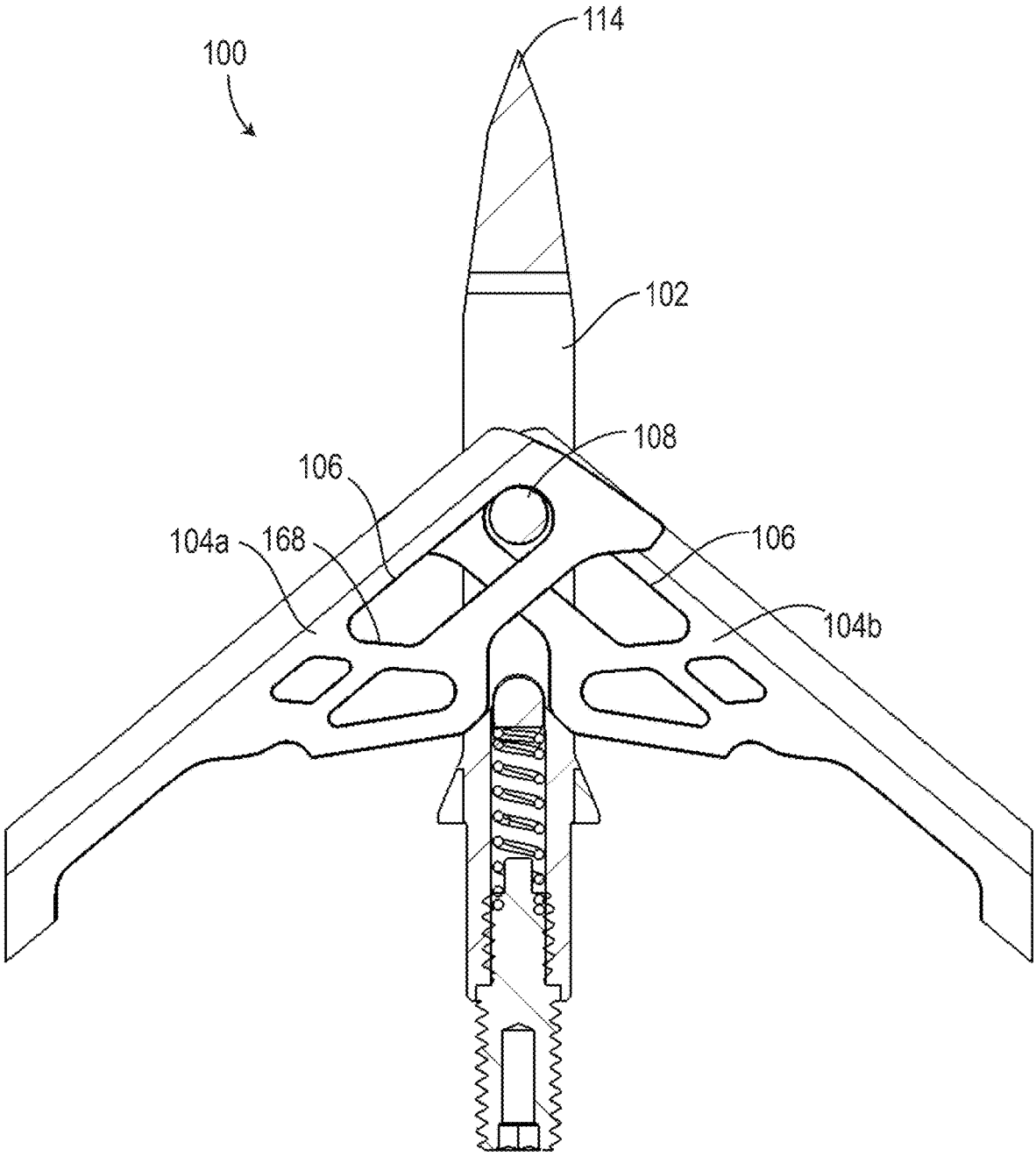
FIG. 19 is a side sectional view of the broadhead of FIG. 16 including the pair of the blade members in the deployed position, according to an exemplary embodiment.

Referring to FIGS. 16-19, another embodiment of the broadhead 100 includes blade members **104*a* and 104*b* as illustrated. The blade members 104*a* and 104*b* can include the slot 106 as described in greater detail above with reference to at least FIG. 14 (e.g., including a rounded or cylindrical end surface on one end and the angled surface 168 on the opposite end). However, the embodiment illustrated in FIGS. 16-19 includes one or more differences relative to the embodiment described in FIG. 14. In particular, the intermediate edge 172 and the shoulder 170 are excluded, and instead, the blade members 104 include a shoulder 180. The shoulder 180 is defined between the engagement surface 156 and a surface 182. An angle formed between the engagement surface 156 and the shoulder 180 is substantially equal to an angle of the frustoconical portion 134 such that, when the blade members 104 are in the deployed position as shown in FIGS. 17 and 19, the surface 182 is substantially parallel with a longitudinal axis (e.g., an axis extending centrally through the body 102). The shoulder 180 can be a generally flat surface that is configured to engage an outer surface of the frustoconical portion 134. The surfaces 182 of the blade members 104 can provide clearance such that the plunger 130** (e.g., the spring-loaded retaining member) has clearance on either side.

As shown in FIGS. 16-19, the engagement surface 156 is provided between the notch 132 and the shoulder 180. The engagement surface 156 has a substantially flat shape and extends in a straight line between the notch 132 and the shoulder 180. The engagement surface 156 is configured to guide deployment of the blades 104 as the blade 104 is moved from the stowed position to the deployed position. In particular, engagement between the plunger 130 and the engagement surface 156 causes the blades 104 to move outwards when pushed rearwards (e.g., away from the tip 114).

As shown in FIGS. 16-19, the contact surfaces 112 of the blade members 104 can have generally flat or arcuate shapes. As shown in FIG. 16, for example, the contact surface 112 protrudes outwards (e.g., in a lateral direction) from the body 102. The contact surface 112 has a slightly curved and generally flat shape. The contact surface 112 can have a curve that decreases in radius (e.g. becomes a sharper curve) proximate the transition between the contact surface 112 and the bladed edge 162 (e.g., at the corner between the contact surface 112 and the bladed edge). In particular, the contact surface 112 can have a similar shape to the contact surface 112 as described in greater detail above with reference to FIG. 10. The embodiment described with reference to FIGS. 16-19 excludes the protrusion 178 described in greater detail above with reference to FIG. 14.

Figure 20:
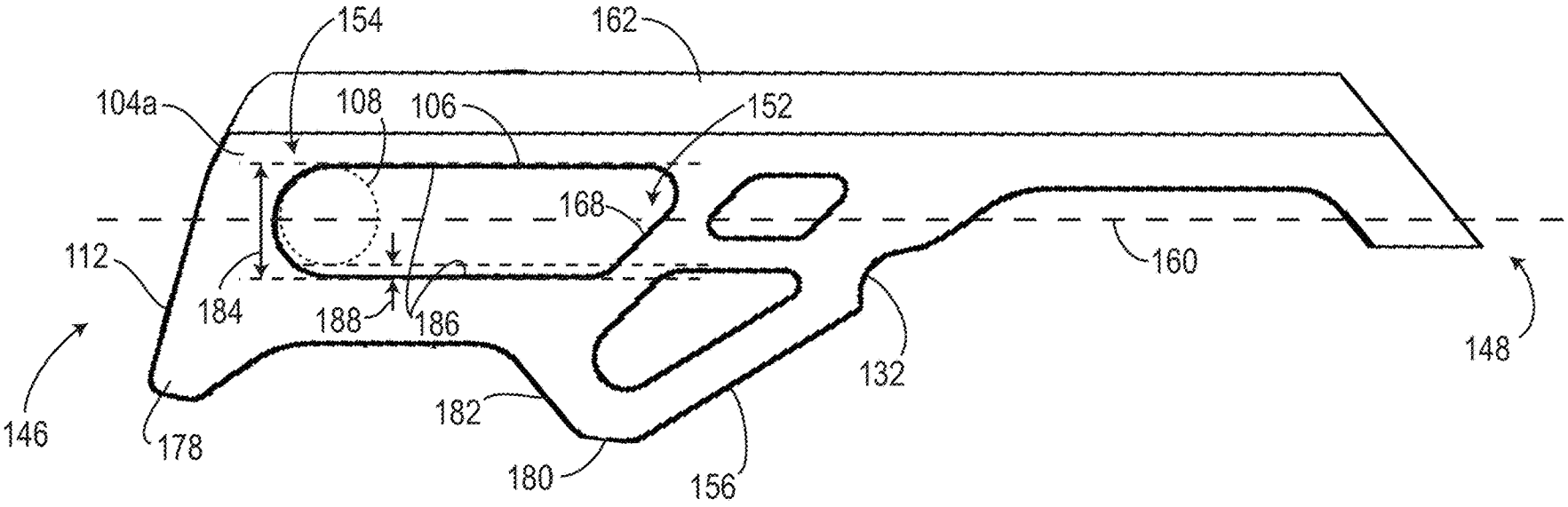
FIG. 20 is a side view of one of the blade members of the broadhead of FIG. 16, according to an exemplary embodiment.

As shown in FIG. 20, the first blade member 104*a* is provided with the slot 106 having a width 184. The width 184 is measured from opposite inner sidewalls 186 of the slot 106. The width 184 is measured in the lateral direction which is perpendicular to the longitudinal centerline 160. The width 184 of the slot 106 is substantially constant along its length. The slot 106 includes the first end 152 that has the angled surface 168 (e.g., angled relative to the longitudinal centerline 160). The slot 106 includes the second end 154 including a rounded or cylindrical inner surface. The width 184 can be greater than a diameter of the pin 108. In some embodiments, a uniform gap 188 is defined between the pin 108 and the inner sidewalls 186 as the blade members 104 transition between the retracted and deployed position. The inner sidewalls 186 are parallel with each other along the length of the slot 106 from the first end 152 to the second end 154. The pin 108 may be allowed to move laterally to some degree between the inner sidewalls 186 but is limited to only being allowed to move by the width of the gap 188. In this way, the pin 108 can experience relative translation along the slot 106 of each of the first blade member 104*a* and the second blade member 104*b* between the first end 152 and the second end 154.

CONFIGURATION OF EXEMPLARY EMBODIMENTS

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claim. It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A broadhead, comprising:

a body defining a target penetrating end;

a first blade member and a second blade member both positioned partially within an inner volume of the body and configured to rotate and translate relative to the body about a pin that is fixedly coupled with the body and is received through a first slot of the first blade member and a second slot of the second blade member, wherein the first blade member and the second blade member are transitionable between retracted positions and deployed positions; and a member biased by a spring in a longitudinal direction towards the target penetrating end, the member configured to be received within a first recess of the first blade member and a second recess of the second blade member when the first blade member and the second blade member are in the retracted positions.

2. The broadhead of claim 1, further including a retaining member coupled in a bore of the body at an end of the body opposite the target penetrating end, the retaining member configured to retain the spring within the bore and also configured to define external threads that protrude from the end of the body opposite the target penetrating end to couple the broadhead with a shaft of an arrow.

3. The broadhead of claim 2, wherein the bore and the inner volume cooperatively form a space within which the member and the spring are positioned.

4. The broadhead of claim 1, wherein the body includes slots formed on opposite sides of the body, the slots providing access to the inner volume through which the first blade member and the second blade member protrude.

5. The broadhead of claim 1, wherein the first recess of the first blade member and the second recess of the second blade member are defined on shoulders of the first blade member and the second blade member, respectively.

6. The broadhead of claim 1, wherein the first blade member includes a first blade along an external edge of the first blade member that protrudes from the body and the second blade member includes a second blade along an external edge of the second blade member that protrudes from the body.

7. The broadhead of claim 1, wherein the first blade member protrudes from a first side of the body and the second blade member protrudes from a second side of the body.

8. The broadhead of claim 1, wherein the first blade member includes a first locking surface and the second blade member includes a second locking surface, wherein the first locking surface and the second locking surface are configured to abut a portion of the body proximate the member when the first blade member and the second blade member are transitioned into the deployed positions to limit movement of the first blade member and the second blade member out of the deployed positions.

9. The broadhead of claim 1, wherein the member is configured to be received within the first recess of the first blade member and the second recess of the second blade member when the first recess and the second recess are aligned with each other when the first blade member and the second blade member are in the retracted positions.

10. A broadhead, comprising:

a body defining a target penetrating end;

a blade member positioned partially within an inner volume of the body and configured to rotate and translate relative to the body by a pin that is fixedly coupled with the body and is received through a slot of the blade member, wherein the blade member is transitionable between a retracted position and a deployed position; and a retainer biased by a spring in a longitudinal direction towards the target penetrating end, the retainer configured to be received within a recess of the blade member when the blade member is in the retracted position.

11. The broadhead of claim 10, further including a retaining member coupled in a bore of the body at an end of the body opposite the target penetrating end, the retaining member configured to retain the spring within the bore and also configured to define external threads that protrude from the end of the body opposite the target penetrating end to couple the broadhead with a shaft of an arrow.

12. The broadhead of claim 11, wherein the bore and the inner volume cooperatively form a space within which the retainer and the spring are positioned.

13. The broadhead of claim 10, wherein the body includes a first opening on a first side and a second opening on a second side, a bladed edge of the blade member configured to protrude from the first opening on the first side, and a contact surface of the blade member configured to protrude from the second opening on the second side when the blade member is in the retracted position.

14. The broadhead of claim 13, wherein the blade member is a first blade member, the broadhead further including a second blade member, a bladed edge of the second blade member configured to protrude from the second opening on the second side, and a contact surface of the second blade member configured to protrude from the first opening on the first side when the second blade member is in the retracted position.

* * * * *